United States Patent [19]

Hattori

[11] 4,077,474

[45] Mar. 7, 1978

[54] FLAME AND SMOKE SHUTOFF SYSTEM

[76] Inventor: Tadashi Hattori, No. 15-20, 1-chome, Kamori, Kishiwada, Osaka, Japan

[21] Appl. No.: 656,693

[22] Filed: Feb. 9, 1976

[30] Foreign Application Priority Data

| | | |
|---|---|---|
| Feb. 14, 1975 | Japan | 50-19158 |
| May 6, 1975 | Japan | 50-55702 |

[51] Int. Cl.[2] ..... E06B 5/16

[52] U.S. Cl. ..... 169/48; 160/1; 169/61; 169/15

[58] Field of Search ..... 169/48–50, 169/15, 14, 61; 160/1–10, 25, 35, 126

[56] References Cited

U.S. PATENT DOCUMENTS

| | | | |
|---|---|---|---|
| 259,063 | 6/1882 | Von Falkenhausen | 169/48 X |
| 803,618 | 11/1905 | Mumford | 169/48 X |
| 998,065 | 7/1911 | Willson | 160/25 |
| 1,027,308 | 5/1912 | Bishop | 169/50 |
| 1,092,243 | 4/1914 | Cole | 169/48 X |
| 1,369,518 | 2/1921 | Bumbarger | 160/1 |
| 2,355,664 | 8/1944 | McMann | 169/61 |
| 2,720,269 | 10/1955 | Diacos | 169/50 |
| 2,761,515 | 9/1956 | Field et al. | 169/48 X |
| 3,687,185 | 8/1972 | Singer | 169/48 |
| 3,872,927 | 3/1975 | Stults | 169/48 |
| 3,877,525 | 4/1975 | Husson et al. | 169/48 |

*Primary Examiner*—John J. Love
*Assistant Examiner*—Michael Mar
*Attorney, Agent, or Firm*—Wenderoth, Lind & Ponack

[57] ABSTRACT

A fire curtain constituted by two nets of nonflammable material is stored in a container on the ceiling and hangs therefrom as soon as a fire starts. Simultaneously, a mixture of water and a bubbling agent in the form of fine bubbles is flown down the curtain to check the spread of flame and smoke. Any section where a fire starts can be isolated from neighboring sections by means of a plurality of such fire curtains. Made of soft, flexible material, the curtain used neither injures a person upon closure nor prevents him from escaping to safer places.

6 Claims, 7 Drawing Figures

FLAME AND SMOKE SHUTOFF SYSTEM

BACKGROUND OF THE INVENTION

The present invention relates to a flame and smoke shutoff system which isolates the area wherein a fire starts from neighboring areas by means of fire curtains to check the spread of flames and smoke.

Fire doors, fire shutters and the like have been heretofore used for this purpose. However, since the devices were usually made of metal, they had the possibility of injuring a person upon closure or trapping and killing persons left behind because they could not be easily opened once closed.

SUMMARY OF THE INVENTION

An object of this invention is to provide a flame and smoke shutoff system which will prevent such injuries.

Another object of this invention is to provide a flame and smoke shutoff system which permits any person left behind to escape easily from the isolated area.

According to the present invention there is provided an improved flame and smoke shutoff system adapted to drop a plurality of fire curtains from the ceiling upon the occurrence of a fire or smoke and at the same time provide a flow a gas shutoff liquid in the form of fine bubbles downward over the entire width of the curtains, thereby checking the spread of flame and smoke. Since the curtain is made of a light, flexible and nonflammable material, it neither injures a person nor prevents him from escaping from the area where a fire has started.

BRIEF DESCRIPTION OF THE DRAWINGS

Other objects and features of this invention will become apparent from the following description with reference to the accompanying drawings in which.

DETAILED DESCRIPTION OF THE INVENTION

Figure 1:
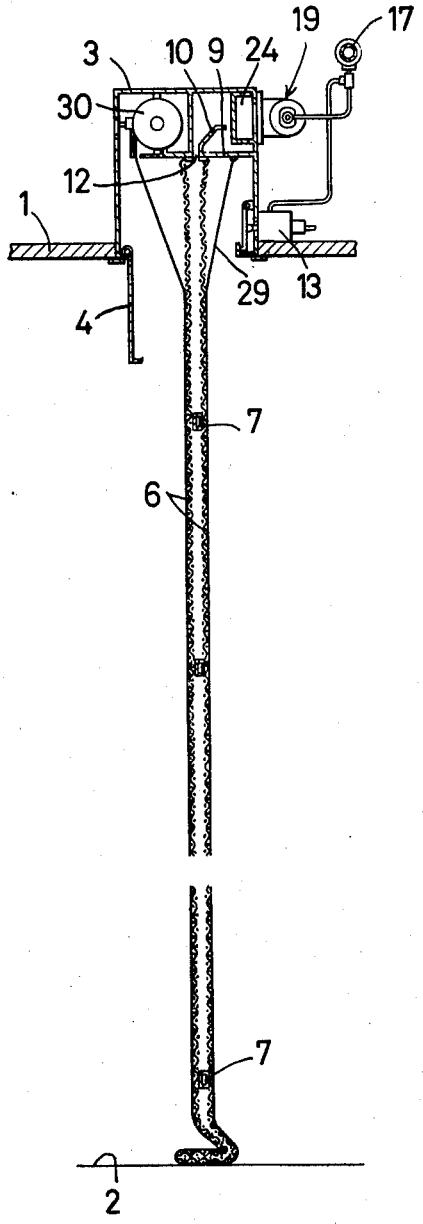
FIG. 1 is a side view of a flame and smoke shutoff system according to the present invention with the curtain down.

Referring to the drawings, the numerals 1 and 2 designate the ceiling and floor, respectively, of a room or passage in which this system is installed. On the ceiling 1 is horizontally mounted a long, box-like container 3 of a length substantially equal to the width of a section to be isolated. The container 3 is closed at its bottom by a cover 4 which is mounted to pivot around a shaft 5 at one side of the container 3. The cover 4 forms a portion of the ceiling when closed.

Figure 3:
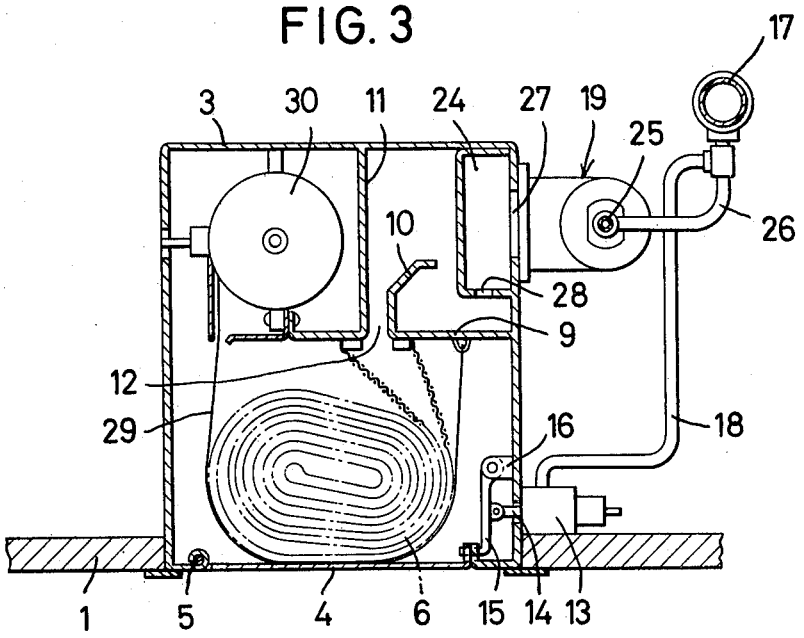
FIG. 3 is another side view thereof with the curtain stored.
Figure 4:
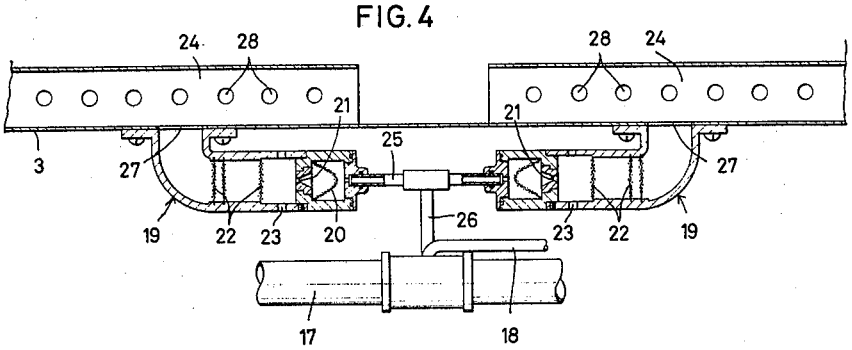
FIG. 4 is a sectional view taken along the lines A—A of FIG. 2.
Figure 6:
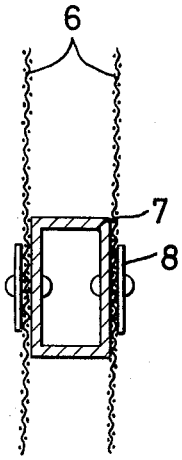
FIG. 6 is a side view of a portion of the curtain.

A fire curtain 6 is constituted by two lightweight, flexible nets (or coarse cloths) made of relatively or totally noncombustible material, such as glass fiber or stainless filament. Normally housed in the container 3 as shown in FIG. 3, the curtain 6 is of a sufficient width to extend over the entire width of the section and is of a sufficient length to reach the floor 2. A uniform spacing is maintained between the two nets by a plurality of spacers 7 extending horizontally, said spacers being steel square tube covered with a soft material such as rubber to avoid injury to a person. As shown in FIG. 6, a disk 8 is bolted to each side of the spacer 7 with a net 6 sandwiched thereinbetween. The spacers 7 also serve as a weight bars.

A horizontal plate 9 extends inwardly from one side wall of the container 3 and has a guide plate 10 extending upwardly from its inner end. The guide plate 10 cooperates with a partition 11 of L-shape section extending downwardly from the top wall of the container 3 to form a longitudinal slit 12 extending over the entire width of the section. The upper ends of the curtain nets are fixed to the inner end of the horizontal plate 9 and the partition 11, respectively.

At bottom of one side of the container 3 are provided a plurality of hydraulic cylinders 13 which have a rod 14 coupled to a pivot bar 15 which is pivoted to a shaft 16 projecting inwardly from the side wall of the container 3. The rod 14 is biassed by a spring (not shown) to project inwardly and the pivot bar 15 normally engages the free end of the cover 4 to hold it closed. When the rod 14 is withdrawn by the hydraulic cylinder 13, the bar 15 disengages the cover 4, which pivots open under its own weight.

On the same side of the container 3 are mounted a plurality of pairs of bubblers 19 for blowing foam into the container 3. Each bubbler 19 is a bent pipe having a strainer 20, a nozzle 21 and three wire gauges 22 incorporated therein in this order. Opposed with their inlets facing to each other, each pair of the bubblers 19 is connected together by a blowoff pipe 25 which is connected to a supply pipe 17 through a branch pipe 26. A mixture of water and a bubbling agent used as a gas shutoff liquid in the preferred embodiment is supplied from the supply pipe 17. Preferably, the bubbling agent has a suitable viscosity.

After passing through the strainer 20, the mixture is jetted from the nozzle 21, when air is sucked in from air inlets 23 around the nozzle. When the mixture strikes the three wire gauges 22 in turn, many fine bubbles is and blown into a diffusion chamber 24 provided over the plate 9. Each bubbler 19 communicates with the diffusion chamber 24 through an opening 27 formed in one side wall of the container 3. The diffusion chambers are open at both ends thereof and have a plurality of perforations 28 formed in their bottom.

Figure 5:
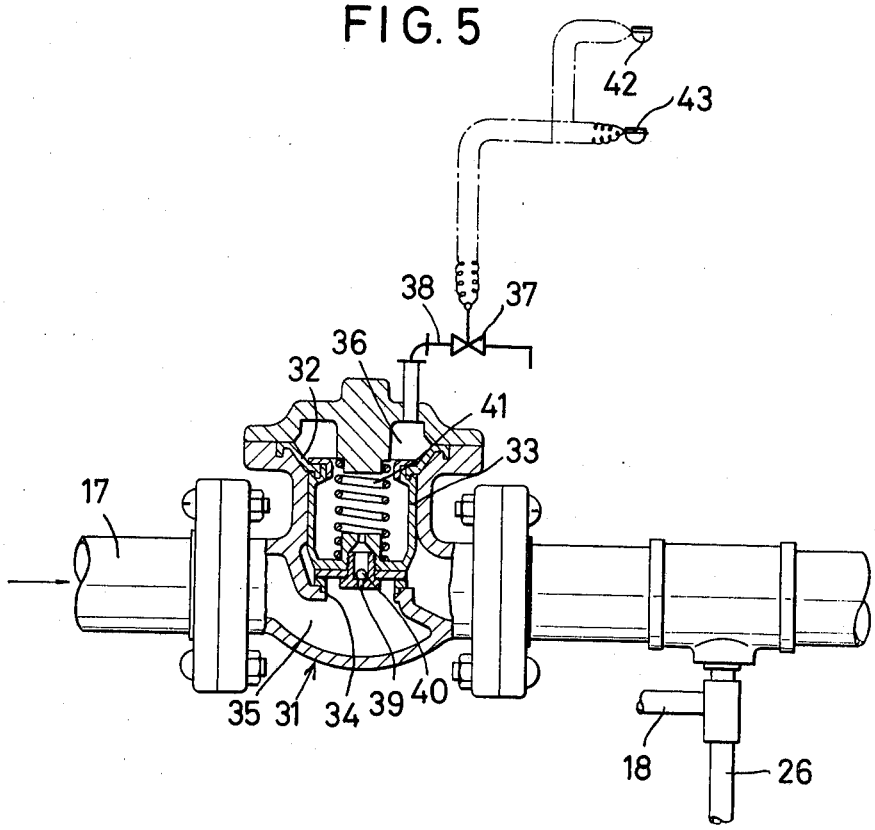
FIG. 5 is a sectional view of a differential valve used therein.

Upstream from the supply pipe 17 is an automatic valve such as a differential valve 31 shown in FIG. 5. The latter has a diaphragm 32 attached to a valve body 33 which normally closes a valve hole 34 from above. This valve has a lower chamber 35 communicating with its inlet and an upper chamber 36 communicating with a solenoid valve 37 through an escape pipe 38. Between these two chambers is formed an orifice 39 over which a ball 40 is mounted to prevent the liquid from flowing from the upper chamber 36 back into the lower chamber 35. The pressure in the upper chamber 36 is adapted to be normally equal to that in the lower chamber 35 with the valve body 33 biassed by a spring 41 toward the valve hole 34.

In each fire-prevention section are an electrical smoke sensor 42 and a heat sensor 43 which operate to transmit an electrical signal upon the detection of smoke or gas over a predetermined concentration or a temperature above a predetermined level.

When the solenoid valve 37 opens in response to the signal, the pressure in the upper chamber 36 of the differential valve 31 decreases so that the liquid in the lower chamber 35 pushes the valve body 33 with the diaphragm 32 upward against the bias of the spring 41 to open the valve hole 34. Thus the liquid flows through the differential valve 31 and downstream.

A plurality of cords 29 wrap vertically around the curtain 6 to wind it up. Each cord has one end fixed to the underside of the plate 9 and the other end wound around a winding drum 30 mounted on the horizontal portion of the partition 11. The winding drum 30 may be operated either by hand or by a motor. As the drum 30 rotates to take up the cords 29, the curtain 6 is rolled up into the lower portion of the container 3 as shown in FIG. 3.

In operation, if a fire should start in any section of a room or a passage, the smoke or heat sensor 42 or 43 automatically operates to transmit an electrical signal to open the solenoid valve 37. Thus, the differential valve 31 opens to allow the liquid to flow to the branch pipes 26 and pipes 18 communicating with the hydraulic cylinders 13.

The hydraulic cylinder 13 operates under liquid pressure to withdraw the rod 14, thus pivoting open the cover 4. The curtain 6 falls down to the floor 2 under its own weight.

Simultaneously, a mixture of water and a bubbling agent is supplied through the blowoff pipes 25 to the bubblers 19 which blow foam into the diffusion chambers 24. The foam overflows them from their open ends and through the perforations 28, filling the space on the horizontal plate 9. Then, it overflows the guide plate 10 and flows down through the slit 12 inbetween the two nets. It flows down therebetween and onto the surface of the nets in an amount sufficient to cover substantially the entire width of the curtain 6 and make it gas-tight, thereby preventing flames and smoke from spreading to other sections of the room or passage. After the fire has been extinguished, the curtain 6 can be rolled up into its original position by means of the winding drum 30.

Although in the preferred embodiment a combination of smoke and heat sensors and a solenoid valve is adopted, known automatic sprinklers may be used instead. In case of fire, the automatic sprinkler operates to sprinkle the section. Accordingly, the pressure in the upper chamber 36 decreases so that the differential valve 31 opens. The hydraulic cylinder 13 may also be replaced by an electromagnet directly connected to the smoke and heat sensors 42 and 43.

The curtain 6 may or may not be provided with cuts extending from its bottom up to a suitable height to further facilitate the escape of persons left behind.

Figure 7:
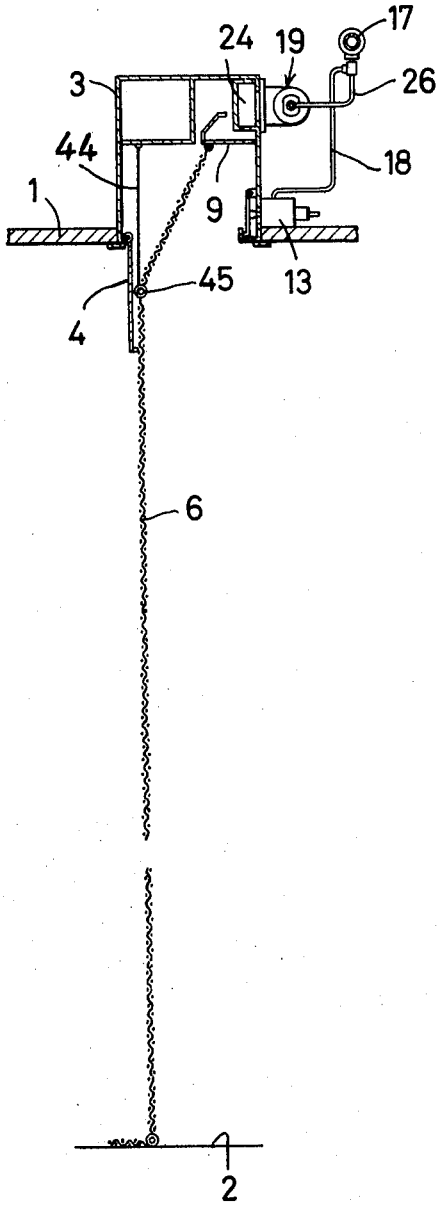
FIG. 7 is a side view similar to FIG. 1 showing another embodiment.
Figure 2:
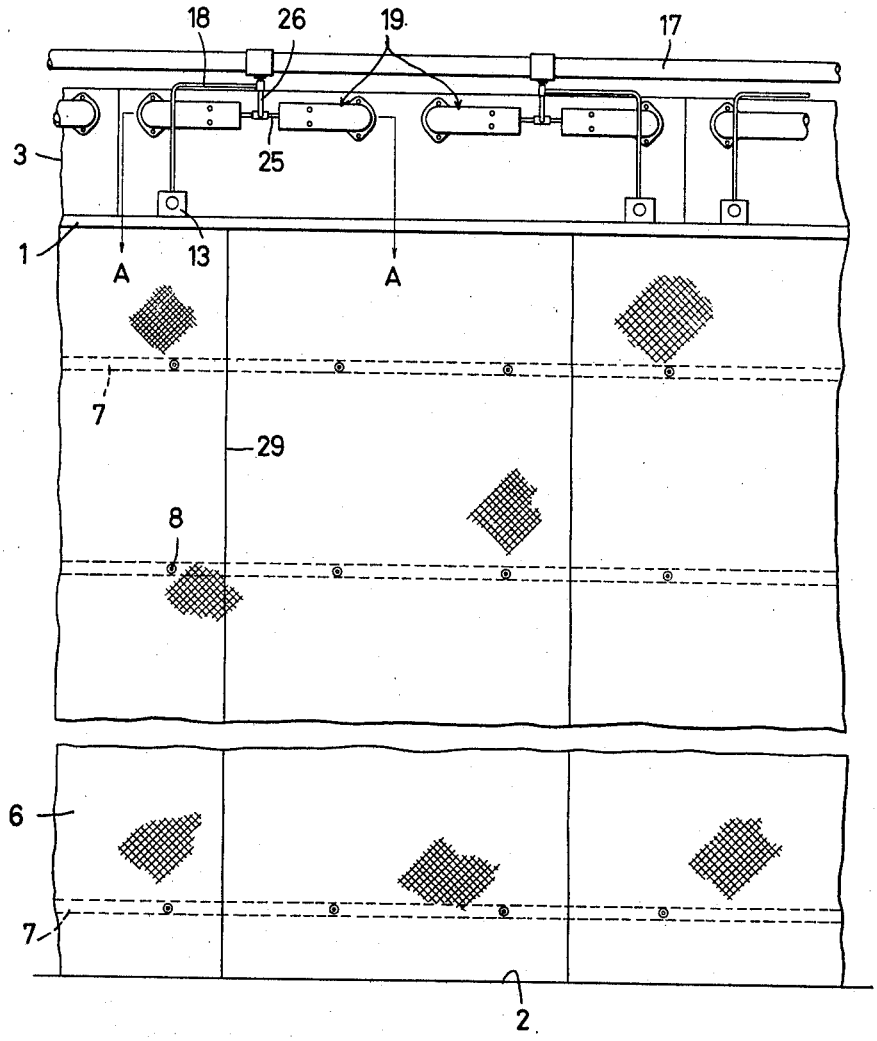
FIG. 2 is a front view thereof.

In the second embodiment shown in FIG. 7 the curtain 6 is constituted by a single net (or coarse cloth), the upper end of which is attached to the inner end of the plate 9. To the upper portion and at the bottom of the curtain is attached a steel weight bar 45 covered with a soft material, such as rubber. The upper weight bar is suspended by a plurality of ropes 44 which are of such a length that when the curtain 6 falls, it will slope above the upper weight bar 45. Foam flows down the slope thus formed and then the vertical portion of the curtain.

If this system is utilized for fire prevention in a wide room, a plurality of the curtains can be arranged in a checkered pattern to divide the room into several sections. For each section, a smoke sensor, a heat sensor, a solenoid valve and an automatic valve are provided. Should a fire occur in any one of the sections, all the curtains serving for the section would fall down simultaneously to isolate it from the neighboring sections.

If this system is installed in a passage, the curtains can be arranged thereacross at a suitable distance to divide it into a plurality of sections. In case of fire, the curtains provided on each end of the fire starting section fall to isolate it.

If it is installed in an underground shopping street, a curtain may be provided over the doorway to each shop. If a single duct connects the shops with one another, the curtains may be mounted in the duct to prevent flame and smoke from running therethrough.

Although the present invention has been described above mainly in connection with fire prevention, it can be applied in tunnels for motorway, subway and railway, passages in coal mines, and the like to shut smoke or harmful gas in a restricted place. Of late, a fire extinguishing method using halogenated gas, carbon dioxide gas or the extinguishing is often used. Some of these gases are expensive and others are detrimental to the human body. A combination of the present flame and smoke shutoff system with such a fire extinguishing method makes it possible to minimize the consumption of expensive gas and greatly lessens the chances of the person left behind inhaling harmful gas by using a gas only in an isolated place.

It will be readily understood that the flame and smoke shutoff system according to the present invention effectively checks the spread of flames and smoke to neighboring areas, thereby greatly facilitating fire extinguishing and escape from the spot where a fire starts. Unlike the conventional metal fire shutters and doors which were hard to open quickly once closed, the fire curtain used in this invention can be easily lifted to escape to safer places because of its light weight and flexibility.

Furthermore, the conventional fire shutter and door hardly transmit light. Should power failure occur after they have been closed, the isolated area would be blacked out, making escape more difficult. On the contrary, the fire curtain used in this invention has the advantage of transmitting a sufficient amount of light from neighboring areas even if power should fail.

Also, even if an explosion should occur in the isolated section, it would not lead to a serious damage because the curtains are easily turned up by a blast.

While preferred embodiments have been described, variations will occur to those skilled in the art within the scope of the present invention.

What is claimed is:

1. A flame and smoke shutoff device for an enclosed area comprising:

a container having a pivotally mounted cover on the underside thereof;

nonflammable curtain means mounted within said container for falling downward from said container when said cover is open and for confining fire and smoke, said curtain means being of sufficient length to hang from said container to a surface below said container, and said curtain means being comprised of:

a double layer of non-flammable curtain material, and spacers horizontally positioned between said double layers for separating said layers;

detecting means for detecting heat and smoke;

cover opening means operatively connected to said cover for opening said cover in response to detecting of heat and smoke by said detecting means;

gas shutoff liquid supply means adjacent said curtain means for supplying a gas shutoff liquid inside said curtain means when said curtain means is hanging downward from said container;

bubbling means between said gas shutoff liquid supply means and said curtain means and directed between said double layer of curtain material for foaming said gas shutoff liquid supplied inbetween said layers of curtain material; and valve means connected to said gas shutoff liquid supply means and said detecting means for controlling the flow of liquid from said gas shutoff liquid supply means.

2. A device as claimed in claim 1 wherein said detecting means is an electronic heat and smoke sensor.

3. A device as claimed in claim 1 wherein said detecting means is an automatic sprinkler.

4. A device as claimed in claim 1 wherein said cover opening means is comprised of:

a latch means operatively connected to said cover for holding said cover closed within said container means; and electromagnetic means adjacent said latch means responsive to said detecting means for energizing when said detecting means is activated and for withdrawing said latch means from said cover, whereby said cover pivots downward.

5. A device as claimed in claim 1 wherein said cover opening means is comprised of:

a latch means operatively connected to said cover for holding said cover closed within said container means; and hydraulic cylinder means connected to said latch means and said gas shutoff liquid supply means for withdrawing said latch means from said cover when said valve means is opened in response to said detection means and said gas shutoff liquid is allowed to flow toward said bubbling means and said cylinder means, whereby said cover pivots downward.

6. A device as claimed in claim 1 wherein said gas shutoff liquid supply means supplies a mixture of water and a bubbling agent.

* * * * *